US011205375B2

(12) United States Patent
Yue et al.

(10) Patent No.: US 11,205,375 B2
(45) Date of Patent: Dec. 21, 2021

(54) PIXEL CIRCUIT HAVING A VOLTAGE CONTROL CIRCUIT FOR LIGHT EMITTING ELEMENT AND DISPLAY DEVICE

(71) Applicant: BOE TECHNOLOGY GROUP CO., LTD., Beijing (CN)

(72) Inventors: Han Yue, Beijing (CN); Can Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/902,128

(22) Filed: Jun. 15, 2020

(65) Prior Publication Data

US 2021/0166617 A1 Jun. 3, 2021

(30) Foreign Application Priority Data

Nov. 29, 2019 (CN) ..... 201922106526.9

(51) Int. Cl.
*G09G 3/32* (2016.01)

(52) U.S. Cl.
CPC ..... *G09G 3/32* (2013.01); *G09G 2310/0272* (2013.01)

(58) Field of Classification Search
CPC ..... G09G 3/32
USPC ..... 345/214
See application file for complete search history.

(56) References Cited

U.S. PATENT DOCUMENTS

2007/0236440 A1* 10/2007 Wacyk ..... G09G 3/3241 345/92
2011/0157133 A1* 6/2011 Ogura ..... G09G 3/3291 345/211
2012/0249516 A1* 10/2012 Wacyk ..... G09G 3/3233 345/212
2016/0365032 A1* 12/2016 Wu ..... G09G 3/3233

* cited by examiner

*Primary Examiner* — Long D Pham
(74) *Attorney, Agent, or Firm* — McCoy Russell LLP

(57) ABSTRACT

The present disclosure provides a pixel circuit and a display device. The pixel circuit includes a light-emitting element, a first voltage control circuit, a light-emitting control circuit, a second voltage control circuit, a control capacitor circuit and a reference voltage write circuit. The reference voltage write circuit is configured to write a reference voltage to the first electrode of the light-emitting element. The second voltage control circuit is configured to, under control of the first gate drive signal, control the second electrode of the light-emitting element to be coupled with the control node, thereby controlling the light-emitting element to be turned on, so that the control capacitor circuit is charged by the reference voltage, a potential at the control node is changed accordingly, until the light-emitting element is turned off.

17 Claims, 7 Drawing Sheets

PIXEL CIRCUIT HAVING A VOLTAGE CONTROL CIRCUIT FOR LIGHT EMITTING ELEMENT AND DISPLAY DEVICE

CROSS-REFERENCE TO RELATED APPLICATION

The present disclosure claims the benefit and priority of Chinese Application No. 201922106526.9, filed on Nov. 29, 2019, the disclosures of which are incorporated in their entirety by reference herein.

TECHNICAL FIELD

The present disclosure relates to the field of display technologies, in particular to a pixel circuit and a display device.

BACKGROUND

In the silicon-based display, because a size of a field effect transistor (FET) used in a source-follower structure is smaller, a higher pixels per inch (PPI) can be achieved, thereby achieving a virtual reality (VR)/augmented reality (AR) display with better display effect. However, a display device in the related art has poor uniformity.

SUMMARY

The present disclosure provides a pixel circuit including: a light-emitting element, a first voltage control circuit, a light-emitting control circuit, a second voltage control circuit, a control capacitor circuit and a reference voltage write circuit.

wherein the first voltage control circuit is electrically coupled with a data line, a first node and a write node, respectively; the first voltage control circuit is configured to, under control of a first write control signal, write a data voltage provided by the data line to the first node and maintain a voltage at the first node, and control a voltage at the write node according to the voltage at the first node;

the reference voltage write circuit is electrically coupled with a first gate line and a first electrode of the light-emitting element, respectively; the reference voltage write circuit is configured to, under control of a first gate drive signal provided by the first gate line, control writing a reference voltage to the first electrode of the light-emitting element;

the control capacitor circuit is electrically coupled with a control node;

the second voltage control circuit is electrically coupled with a second electrode of the light-emitting element, the control node, a follower node and the first gate line, respectively; the second voltage control circuit is configured to, under control of the first gate drive signal, control the second electrode of the light-emitting element to be coupled with the control node, thereby controlling the light-emitting element to be turned on, so that the control capacitor circuit is charged by the reference voltage, a potential at the control node is changed accordingly, until the light-emitting element is turned off; the second voltage control circuit is further configured to control a voltage at the follower node according to a voltage at the control node;

the light-emitting control circuit is electrically coupled with a light-emitting control line, the write node, the first electrode of the light-emitting element, the second electrode of the light-emitting element, and the follower node, respectively; the light-emitting control circuit is configured to, under control of a light-emitting control signal provided by the light-emitting control line, control the write node to be coupled with the first electrode of the light-emitting element, and control the second electrode of the light-emitting element to be coupled with the follower node.

In implementation, the second voltage control circuit includes a reset circuit, a switch circuit, and a first voltage follower circuit;

the reset circuit is electrically coupled with a reset terminal and the control node, respectively; the reset circuit is configured to, under control of a reset signal provided by the reset terminal, control providing a reset voltage to the control node;

the switch circuit is electrically coupled with the first gate line, the control node and the second electrode of the light-emitting element, respectively; the switch circuit is configured to, under control of the first gate drive signal, control the control node to be coupled with the second electrode of the light-emitting element;

the first voltage follower circuit is electrically coupled with the control node and the follower node, respectively; the first voltage follower circuit is configured to control the voltage at the follower node according to the voltage at the control node.

In implementation, the reset circuit includes a reset transistor; the switch circuit includes a switch control transistor; the first voltage follower circuit includes a first source-follower transistor; the control capacitor circuit includes a control capacitor;

a control electrode of the reset transistor is electrically coupled with the reset terminal; a first electrode of the reset transistor is electrically coupled with a reset voltage terminal; a second electrode of the reset transistor is electrically coupled with the control node; the reset voltage terminal is configured to provide the reset voltage;

a control electrode of the switch control transistor is electrically coupled with the first gate line; a first electrode of the switch control transistor is electrically coupled with the second electrode of the light-emitting element; a second electrode of the switch control transistor is electrically coupled with the control node;

a gate electrode of the first source-follower transistor is electrically coupled with the control node; a source electrode of the first source-follower transistor is electrically coupled with the follower node; a second electrode of the first source-follower transistor is electrically coupled with a first voltage terminal;

a first terminal of the control capacitor is electrically coupled with the control node; a second terminal of the control capacitor receives a first common voltage.

In implementation, the reference voltage write circuit includes a reference voltage write transistor;

a control electrode of the reference voltage write transistor is electrically coupled with the first gate line; a first electrode of the reference voltage write transistor is electrically coupled with a reference voltage terminal; a second electrode of the reference voltage write transistor is electrically coupled with the first electrode of the light-emitting element; the reference voltage terminal is configured to provide the reference voltage.

In implementation, the first voltage control circuit includes a second voltage follower circuit, a data voltage write circuit, and a voltage maintenance circuit;

the second voltage follower circuit is configured to control the voltage at the write node according to the voltage at the first node;

the data voltage write circuit is configured to, under control of the first write control signal, write the data voltage to the first node;

the voltage maintenance circuit is configured to maintain the voltage at the first node.

In implementation, the second voltage follower circuit includes a second source-follower transistor, and the voltage maintenance circuit includes a storage capacitor;

a control electrode of the second source-follower transistor is electrically coupled with the first node; a drain electrode of the second source-follower transistor is electrically coupled with a power supply voltage terminal; a second electrode of the second source-follower transistor is electrically coupled with the write node;

a first terminal of the storage capacitor is electrically coupled with the first node; a second terminal of the storage capacitor receives a second common voltage.

In implementation, the first write control signal includes a first gate drive signal and a second gate drive signal;

the data voltage write circuit includes a first data write transistor and a second data write transistor;

a control electrode of the first data write transistor is electrically coupled with a second gate line; a first electrode of the first data write transistor is electrically coupled with the data line; a second electrode of the first data write transistor is electrically coupled with the first node;

a control electrode of the second data write transistor is electrically coupled with the first gate line; a first electrode of the second data write transistor is electrically coupled with the data line; a second electrode of the second data write transistor is electrically coupled with the first node;

the first data write transistor is a p-type transistor, and the second data write transistor is an n-type transistor.

In implementation, the light-emitting control circuit includes a first light-emitting control transistor and a second light-emitting control transistor;

a control electrode of the first light-emitting control transistor is electrically coupled with the light-emitting control line; a first electrode of the first light-emitting control transistor is electrically coupled with the write node; a second electrode of the first light-emitting control transistor is electrically coupled with the first electrode of the light-emitting element;

a control electrode of the second light-emitting control transistor is electrically coupled with a light-emitting control line; a first electrode of the second light-emitting control transistor is electrically coupled with the second electrode of the light-emitting element; a second electrode of the second light-emitting control transistor is electrically coupled with the follower node.

The present disclosure further provides a display device including the above display device.

In implementation, the display device further includes a silicon substrate; and the pixel circuit is disposed on the silicon substrate.

DETAILED DESCRIPTION

The technical solutions in the embodiments of the present disclosure will be described hereinafter in a clear and complete manner in conjunction with the drawings in the embodiments of the present disclosure. Obviously, the following embodiments are merely a part of, rather than all of, the embodiments of the present disclosure, and based on these embodiments, a person skilled in the art may obtain the other embodiments, which also fall within the scope of the present disclosure.

A source-follower structure controls brightness by controlling voltages at two ends of a light-emitting diode. Light-emitting diodes have poor efficiency uniformity due to difference in material/process uniformity and attenuation uniformity in use, that is, the light-emitting diodes show different brightness when the same voltages are applied to two ends of each of the light-emitting diodes, which causes the brightness non-uniformity and chromaticity non-uniformity of the final display. In terms of light-emitting diode specifications, this non-uniformity is mainly manifested as difference in turn-on voltages Vf. Brightness of light-emitting diodes is different under the same driving voltage due to different turn-on voltages of the light-emitting diodes, resulting in poor display uniformity.

In view of this, embodiments of the present disclosure provides a pixel circuit and a display device, which can solve the problem in the related art that brightness of light-emitting elements is different under the same driving voltage due to different turn-on voltages of the light-emitting elements, resulting in poor display uniformity.

Transistors used in all the embodiments of the present disclosure may be triodes, thin film transistors, field effect transistors, or other devices with the same characteristics. In one embodiment of the present disclosure, in order to distinguish two electrodes of the transistor other than a control electrode, one of the two electrodes is referred as a first electrode, and the other one of the two electrodes is referred as a second electrode.

In actual operation, when the transistor is a triode, the control electrode may be a base electrode, the first electrode may be a collector electrode, and the second electrode may be an emitter electrode; or, the control electrode may be a base electrode, the first electrode may be an emitter electrode, and the second electrode may be a collector electrode.

In actual operation, when the transistor is a thin film transistor or a field effect transistor, the control electrode may be a gate electrode, the first electrode may be a drain electrode, and the second electrode may be a source electrode; or, the control electrode may be a gate electrode, the first electrode may be a source electrode, and the second electrode may be a drain electrode.

Figure 1:
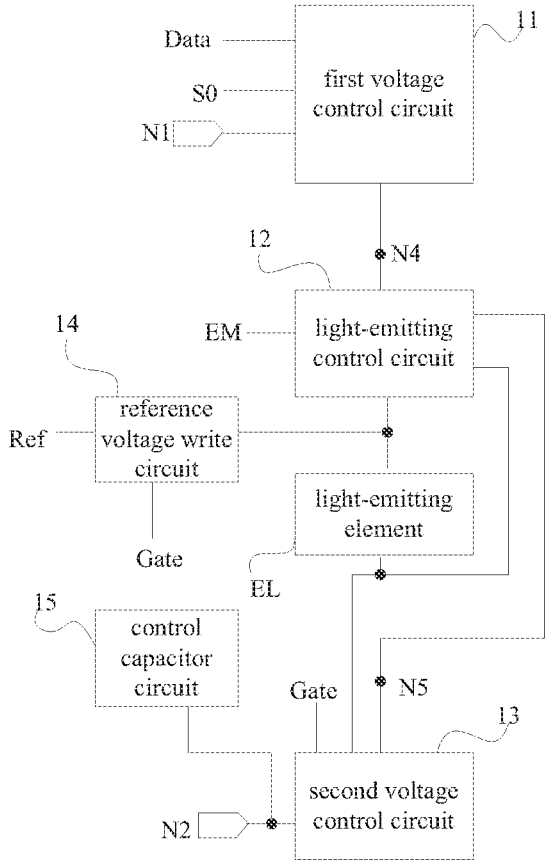
FIG. 1 is a schematic diagram of a pixel circuit according to an embodiment of the present disclosure.

As shown in FIG. 1, a pixel circuit according to one embodiment of the present disclosure includes a light-emitting element EL, a first voltage control circuit 11, a light-emitting control circuit 12, a second voltage control circuit 13, a reference voltage write circuit 14 and a control capacitor circuit 15.

The first voltage control circuit 11 is electrically coupled with a data line Data, a first node N1 and a write node N4, respectively. The first voltage control circuit 11 receives a first write control signal S0. The first voltage control circuit 11 is configured to, under control of the first write control signal S0, write a data voltage Vdata provided by the data line Data into the first node N1 and maintain a voltage at the first node N1; control a voltage at the write node N4 according to the voltage at the first node N1.

The reference voltage write circuit 14 is electrically coupled with a first gate line Gate, a reference voltage terminal Ref, and a first electrode of the light-emitting element EL, respectively. The reference voltage terminal Ref is used to provide a reference voltage Vref. The reference voltage write circuit 14 is configured to, under control of a first gate drive signal provided by the first gate line Gate, control writing the reference voltage Vref to the first electrode of the light-emitting element EL.

The control capacitor circuit 15 is electrically coupled with a control node N2.

The second voltage control circuit 13 is electrically coupled with the first gate line Gate, a second electrode of the light-emitting element EL, the control node N2 and a follower node N5, respectively. The second voltage control circuit 13 is configured to, under control of the first gate drive signal, control the second electrode of the light-emitting element EL to be coupled with the control node N2, thereby controlling the light-emitting element EL to be turned on, so that the control capacitor circuit 15 is charged by the reference voltage Vref, a potential at the control node N2 is changed accordingly, until the light-emitting element EL is turned off. The second voltage control circuit 13 is further configured to control a voltage at the follower node N5 according to a voltage at the control node N2.

The light-emitting control circuit 12 is electrically coupled with a light-emitting control line EM, the write node N4, the first electrode of the light-emitting element EL, the second electrode of the light-emitting element EL, and the follower node N5, respectively. The light-emitting control circuit 12 is configured to, under control of a light-emitting control signal provided by the light-emitting control line EM, control the write node N4 to be coupled with the first electrode of the light-emitting element EL, and control the second electrode of the light-emitting element EL to be coupled with the follower node N5.

In the pixel circuit according to one embodiment of the present disclosure, the first voltage control circuit 11 and the light-emitting control circuit 12 controls the voltage at the first electrode of the light-emitting element EL; and in a light-emitting phase, the reference voltage write circuit 14, the second voltage control circuit 13, the control capacitor circuit 15 and the light-emitting control circuit 12 control the voltage at the second electrode of the light-emitting element EL to be related to the turn-on voltage Vf of the light-emitting element EL, so that in the light-emitting phase, the brightness of the light-emitting element EL is independent of the turn-on voltage Vf. Therefore, the pixel circuit according to one embodiment of the present disclosure can compensate for the influence of the turn-on voltage Vf of the light-emitting element EL on the light-emitting brightness.

In specific implementation, the first voltage control circuit 11 may also be electrically coupled with a control line that provides the first write control signal. In one embodiment of the present disclosure, the first write control signal may include a first gate drive signal and a second gate drive signal, and the control line may include a first gate line and a second gate line, but not limited to this.

In one embodiment of the present disclosure, the light-emitting element may be a light-emitting diode or an organic light-emitting diode. The first electrode of the light-emitting element is an anode, and the second electrode of the light-emitting element is a cathode, but not limited to this.

When the pixel circuit according to one embodiment of the present disclosure is in operation, a display period may include a compensation phase and a light-emitting phase that are sequentially set.

In the compensation phase, under control of the first write control signal, the first voltage control circuit 11 writes the data voltage Vdata provided by the data line Data to the first node N1 and maintains the voltage at the first node N1; under control of the first gate drive signal provided by the first gate line Gate, the reference voltage write circuit 14 controls writing the reference voltage Vref to the first electrode of the light-emitting element EL.

Under control of the first gate drive signal, the second voltage control circuit 13 controls the second electrode of the light-emitting element EL to be coupled with the control node N2, thereby controlling the light-emitting element EL to be turned on, so that the control capacitor circuit 15 is charged by the reference voltage Vref, a potential at the control node N2 is changed accordingly, until the light-emitting element EL is turned off. At this point, the potential at the control node N2 may be equal to Vref-Vf, where Vf is the turn-on voltage of the light-emitting element EL.

In the light-emitting phase, the second voltage control circuit 13 controls the voltage at the follower node N5 according to the voltage at the control node N2; the first voltage control circuit 11 controls the voltage at the write node N4 according to the voltage at the first node N1; under control of the light-emitting control signal provided by the light-emitting control line EM, the light-emitting control circuit 12 controls the write node N4 to be coupled with the first electrode of the light-emitting element EL, and controls the second electrode of the light-emitting element EL to be coupled with the follower node N5, thereby controlling the light-emitting element EL to emit light. At this point, a voltage difference between the voltage at the first electrode of the light-emitting element EL and the voltage at the second electrode of the light-emitting element EL is related to the turn-on voltage Vf, so that the current flowing through the light-emitting element EL is independent of the turn-on voltage Vf.

Specifically, the second voltage control circuit includes a reset circuit, a switch circuit, and a first voltage follower circuit.

The reset circuit is electrically coupled with a reset terminal and the control node, respectively. The reset circuit is configured to, under control of a reset signal provided by the reset terminal, control providing a reset voltage to the control node.

The switch circuit is electrically coupled with the first gate line, the control node and the second electrode of the light-emitting element, respectively. The switch circuit is configured to, under control of the first gate drive signal, control the control node to be coupled with the second electrode of the light-emitting element.

The first voltage follower circuit is electrically coupled with the control node and the follower node, respectively. The first voltage follower circuit is configured to control the voltage at the follower node according to the voltage at the control node.

When the second voltage control circuit includes the reset circuit, the switch circuit and the first voltage follower circuit, the display period may further include a reset phase before the compensation phase.

In the reset phase, under control of the reset signal provided by the reset terminal, the reset circuit controls providing the reset voltage to the control node, so that the light-emitting element keeps turning-on at the beginning of the compensation phase.

In the compensation phase, under control of the first gate drive signal, the switch circuit controls the control node to be coupled with the second electrode of the light-emitting element.

In the light-emitting phase, the first voltage follower circuit controls the voltage at the follower node according to the voltage at the control node.

Figure 2:
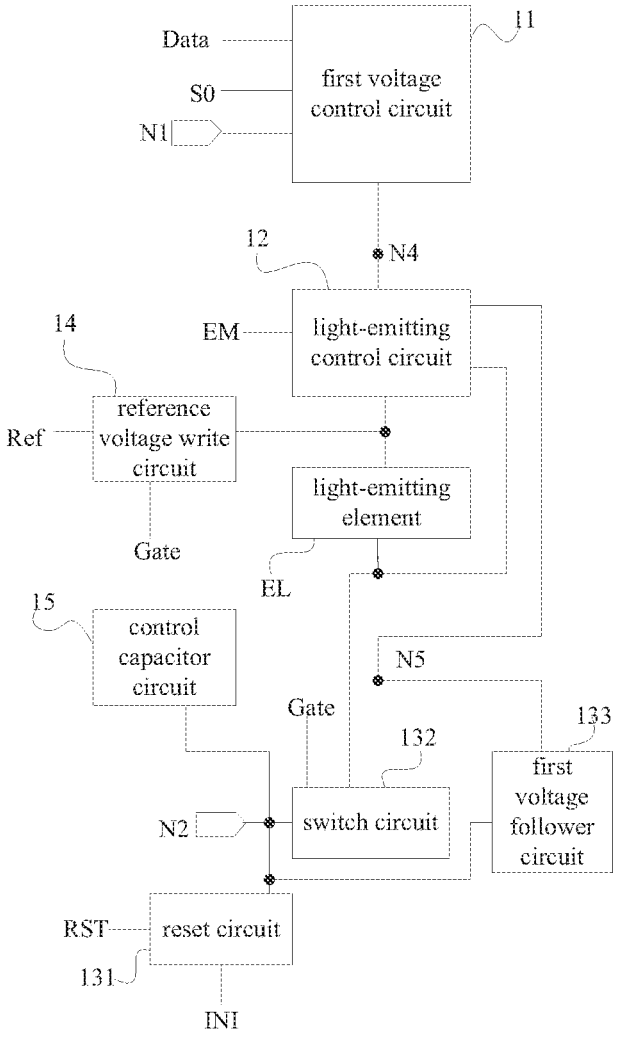
FIG. 2 is a schematic diagram of a pixel circuit according to another embodiment of the present disclosure.

As shown in FIG. 2, on the basis of the embodiment of the pixel circuit shown in FIG. 1, the second voltage control circuit may include a reset circuit 131, a switch circuit 132 and a first voltage follower circuit 133.

The reset circuit 131 is electrically coupled with a reset terminal RST, a reset voltage terminal INI and the control node N2, respectively. The reset voltage terminal INI is configured to provide a reset voltage Vini. The reset circuit 131 is configured to, under control of a reset signal provided by the reset terminal RST, control providing the reset voltage Vini to the control node N2.

The switch circuit 132 is electrically coupled with the first gate line Gate, the control node N2 and the second electrode of the light-emitting element EL, respectively. The switch circuit 132 is configured to, under control of the first gate drive signal provided by the first gate line Gate, control the control node N2 to be coupled with the second electrode of the light-emitting element EL.

The first voltage follower circuit 133 is electrically coupled with the control node N2 and the follower node N5, respectively. The first voltage follower circuit 133 is configured to control the voltage at the follower node N5 according to the voltage at the control node N2.

Specifically, the reset circuit may include a reset transistor. The switch circuit may include a switch control transistor. The first voltage follower circuit may include a first source-follower transistor. The control capacitor circuit may include a control capacitor.

A control electrode of the reset transistor is electrically coupled with the reset terminal. A first electrode of the reset transistor is electrically coupled with the reset voltage terminal. A second electrode of the reset transistor is electrically coupled with the control node. The reset voltage terminal is configured to provide the reset voltage.

A control electrode of the switch control transistor is electrically coupled with the first gate line. A first electrode of the switch control transistor is electrically coupled with the second electrode of the light-emitting element. A second electrode of the switch control transistor is electrically coupled with the control node.

A gate electrode of the first source-follower transistor is electrically coupled with the control node. A source electrode of the first source-follower transistor is electrically coupled with the follower node. A second electrode of the first source-follower transistor is electrically coupled with the first voltage terminal.

A first terminal of the control capacitor is electrically coupled with the control node. A second terminal of the control capacitor receives a first common voltage.

In one embodiment of the present disclosure, the first voltage terminal may be a low voltage terminal or a ground terminal, but not limited to this.

In one embodiment of the present disclosure, when the first source-follower transistor is turned on, a source voltage of the first source-follower transistor is equal to a difference between a gate voltage of the first source-follower transistor and a threshold voltage of the first source-follower transistor.

Specifically, the reference voltage write circuit may include a reference voltage write transistor.

A control electrode of the reference voltage write transistor is electrically coupled with the first gate line. A first electrode of the reference voltage write transistor is electrically coupled with a reference voltage terminal. A second electrode of the reference voltage write transistor is electrically coupled with the first electrode of the light-emitting element. The reference voltage terminal is configured to provide the reference voltage.

In specific implementation, the reference voltage write circuit may include a reference voltage write transistor. In the compensation phase, the reference voltage write transistor is turned on to write the reference voltage Vref to the first electrode of the light-emitting element, so that the voltage at the second electrode of the light-emitting element becomes Vref-Vf, where Vf is the turn-on voltage of the light-emitting element.

Specifically, the first voltage control circuit may include a second voltage follower circuit, a data voltage write circuit, and a voltage maintenance circuit.

The second voltage follower circuit is configured to control the voltage at the write node according to the voltage at the first node.

The data voltage write circuit is configured to, under control of the first write control signal, write the data voltage to the first node.

The voltage maintenance circuit is configured to maintain the voltage at the first node.

In specific implementation, the first voltage control circuit may include the second voltage follower circuit, the data voltage write circuit and the voltage maintenance circuit; in the compensation phase, the data voltage write circuit controls writing the data voltage to the first node. In the compensation phase and the light-emitting phase, the voltage maintenance circuit maintains the voltage at the first node to be the data voltage; and, according to the voltage at the first node, the second voltage follower circuit controls the voltage at the write node to be a difference between the data voltage and a threshold voltage of a second source-follower transistor included in the second voltage follower circuit.

Specifically, the second voltage follower circuit may include a second source-follower transistor, and the voltage maintenance circuit includes a storage capacitor.

A control electrode of the second source-follower transistor is electrically coupled with the first node. A drain electrode of the second source-follower transistor is electrically coupled with a power supply voltage terminal. A second electrode of the second source-follower transistor is electrically coupled with the write node.

A first terminal of the storage capacitor is electrically coupled with the first node. A second terminal of the storage capacitor receives a second common voltage.

In one embodiment of the present disclosure, when the second source-follower transistor is turned on, a source voltage of the second source-follower transistor is equal to a difference between a gate voltage of the second source-follower transistor and a threshold voltage of the second source-follower transistor.

Figure 3:
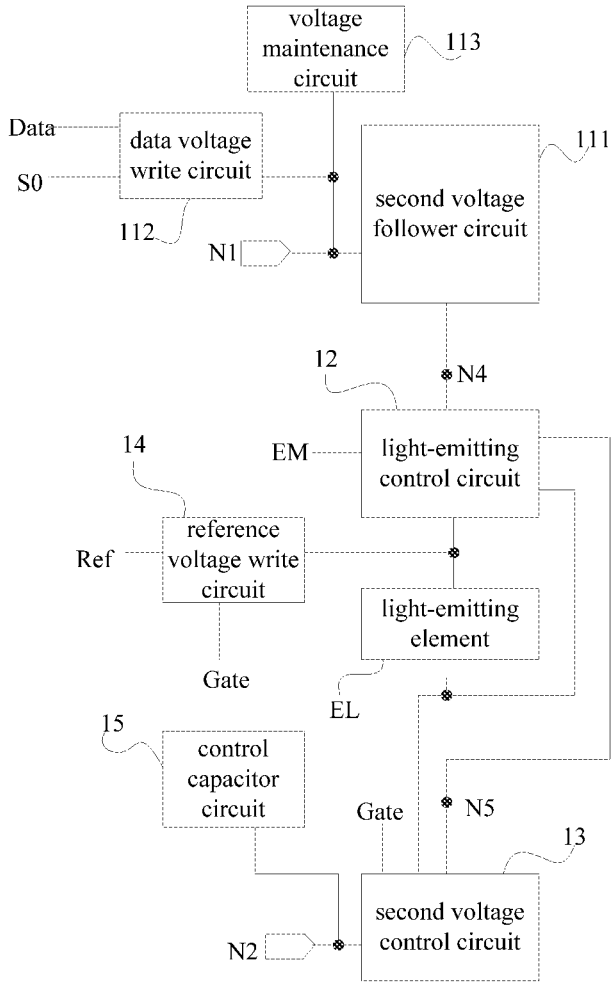
FIG. 3 is a schematic diagram of a pixel circuit according to still another embodiment of the present disclosure.

As shown in FIG. 3, on the basis of the embodiment of the pixel circuit shown in FIG. 1, the first voltage control circuit may include a second voltage follower circuit 111, a data voltage write circuit 112 and a voltage maintenance circuit 113.

The second voltage follower circuit 111 is electrically coupled with the first node N1 and the write node N4, respectively. The second voltage follower circuit 111 is configured to control the voltage at the write node N4 according to the voltage at the first node N1.

The data voltage write circuit 112 receives the first write control signal SO. The data line Data is configured to provide a data voltage Vdata. The data voltage write circuit 112 is electrically coupled with the data line Data and the first node N1, respectively. The data voltage write circuit 112 is configured to, under control of the first write control signal SO, write the data voltage Vdata to the first node N1.

The voltage maintenance circuit 113 is electrically coupled with the first node N1 and is configured to maintain the voltage at the first node N1.

In implementation, the first write control signal may include a first gate drive signal and a second gate drive signal.

The data voltage write circuit includes a first data write transistor and a second data write transistor.

A control electrode of the first data write transistor is electrically coupled with the second gate line. A first electrode of the first data write transistor is electrically coupled with the data line. A second electrode of the first data write transistor is electrically coupled with the first node.

A control electrode of the second data write transistor is electrically coupled with the first gate line. A first electrode of the second data write transistor is electrically coupled with the data line. A second electrode of the second data write transistor is electrically coupled with the first node.

The first data write transistor is a p-type transistor, and the second data write transistor is an n-type transistor.

In one embodiment of the present disclosure, the first data write transistor and the second data write transistor may be complementary transistors to extend the range of data voltages that can be written to the first node.

Specifically, the light-emitting control circuit may include a first light-emitting control transistor and a second light-emitting control transistor.

A control electrode of the first light-emitting control transistor is electrically coupled with the light-emitting control line. A first electrode of the first light-emitting control transistor is electrically coupled with the write node. A second electrode of the first light-emitting control transistor is electrically coupled with the first electrode of the light-emitting element.

A control electrode of the second light-emitting control transistor is electrically coupled with the light-emitting control line. A first electrode of the second light-emitting control transistor is electrically coupled with the second electrode of the light-emitting element. A second electrode of the second light-emitting control transistor is electrically coupled with the follower node.

In specific implementation, the light-emitting control circuit may include a first light-emitting control transistor and a second light-emitting control transistor. In the light-emitting phase, the first light-emitting control transistor and the second light-emitting control transistor are turned on to control the write node to be coupled with the first electrode of the light-emitting element, and control the second electrode of the light-emitting element to be coupled with the follower node.

The pixel circuit of the present disclosure will be described hereinafter with a specific embodiment.

Figure 4:
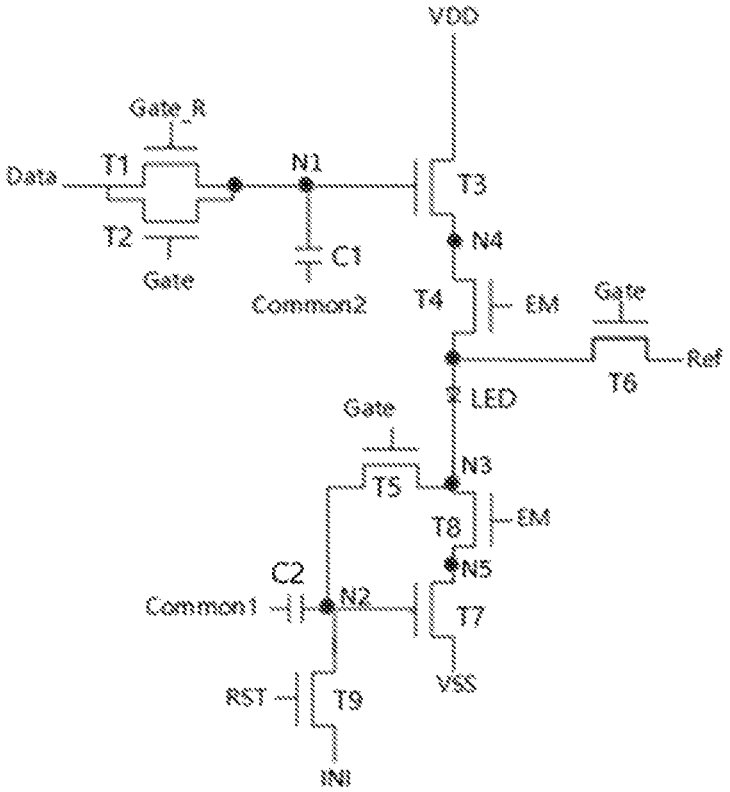
FIG. 4 is a circuit diagram of a pixel circuit according to an embodiment of the present disclosure.

As shown in FIG. 4, a pixel circuit according to a specific embodiment of the present disclosure includes a light-emitting diode LED, a first voltage control circuit, a light-emitting control circuit, a second voltage control circuit, a control capacitor circuit, and a reference voltage write circuit.

The second voltage control circuit includes a reset circuit, a switch circuit, and a first voltage follower circuit.

The reset circuit includes a reset transistor T9. The switch circuit includes a switch control transistor T5. The first voltage follower circuit includes a first source-follower transistor T7. The control capacitor circuit includes a control capacitor C2.

A gate electrode of the reset transistor T9 is electrically coupled with the reset terminal RST. A drain electrode of the reset transistor T9 is electrically coupled with the reset voltage terminal INI. A source electrode of the reset transistor T9 is electrically coupled with the control node N2. The reset voltage terminal INI is configured to provide the reset voltage Vini.

A gate electrode of the switch control transistor T5 is electrically coupled with the first gate line Gate. A drain electrode of the switch control transistor T5 is electrically coupled with a cathode of the light-emitting diode LED. A source electrode of the switch control transistor T5 is electrically coupled with the control node N2. The cathode of the light-emitting diode LED is electrically coupled with a cathode node N3.

A gate electrode of the first source-follower transistor T7 is electrically coupled with the control node N2. A source electrode of the first source-follower transistor T7 is electrically coupled with the follower node N5. A drain electrode of the first source-follower transistor T7 is electrically coupled with a low voltage terminal. The low voltage terminal is configured to provide a low voltage VSS.

A first terminal of the control capacitor C2 is electrically coupled with the control node N2. A second terminal of the control capacitor C2 receives a first common voltage Common1.

The reference voltage write circuit includes a reference voltage write transistor T6.

A gate electrode of the reference voltage write transistor T6 is electrically coupled with the first gate line Gate. A drain electrode of the reference voltage write transistor T6 is electrically coupled with the reference voltage terminal Ref. A source electrode of the reference voltage write transistor T6 is electrically coupled with an anode of the light-emitting diode LED. The reference voltage terminal Ref is configured to provide the reference voltage Vref.

The first voltage control circuit includes a second voltage follower circuit, a data voltage write circuit and a voltage maintenance circuit.

The second voltage follower circuit includes a second source-follower transistor T3. The voltage maintenance circuit includes a storage capacitor C1.

A gate electrode of the second source-follower transistor T3 is electrically coupled with the first node N1. A drain electrode of the second source-follower transistor T2 is electrically coupled with a power supply voltage terminal. A source electrode of the second source-follower transistor T2 is electrically coupled with the write node N4. The power supply voltage terminal is configured to provide a power supply voltage VDD.

A first terminal of the storage capacitor C1 is electrically coupled with the first node N1. A second terminal of the storage capacitor receives a second common voltage Common2.

The data voltage write circuit includes a first data write transistor T1 and a second data write transistor T2.

A gate electrode of the first data write transistor T1 is electrically coupled with a second gate line Gate_R. A source electrode of the first data write transistor T1 is electrically coupled with the data line Data. A drain electrode of the first data write transistor T1 is electrically coupled with the first node N1.

A gate electrode of the second data write transistor T2 is electrically coupled with the first gate line Gate. A drain electrode of the second data write transistor T2 is electrically coupled with the data line. A source electrode of the second data write transistor T2 is electrically coupled with the first node N1.

The light-emitting control circuit includes a first light-emitting control transistor T4 and a second light-emitting control transistor T8.

A gate electrode of the first light-emitting control transistor T4 is electrically coupled with the light-emitting control line EM. A drain electrode of the first light-emitting control transistor T4 is electrically coupled with the write node N4.

A source electrode of the first light-emitting control transistor T4 is electrically coupled with an anode of the light-emitting diode LED.

A gate electrode of the second light-emitting control transistor T8 is electrically coupled with the light-emitting control line EM. A drain electrode of the second light-emitting control transistor T8 is electrically coupled with a cathode of the light-emitting diode. A second electrode of the second light-emitting control transistor T8 is electrically coupled with the follower node N5.

In the specific embodiment of the pixel circuit shown in FIG. 4, T3 is an N-type field effect transistor (FET), T7 is a P-type FET, T3 and T7 are driving transistors, and the other transistors are switching transistors.

In FIG. 4, T1 is a P-type FET, T2 is an N-type FET, and T4, T5, T6, T8, and T9 are all N-type FETs, but not limited to this.

In one embodiment of the present disclosure, the first common voltage Common1 may be a low voltage or a ground voltage, and the second common voltage Common2 may be a low voltage or a ground voltage, but not limited thereto.

When the pixel circuit shown in FIG. 4 according to a specific embodiment of the present disclosure is in operation, a display cycle includes a reset phase, a compensation phase, and a light-emitting phase that are sequentially set.

Figure 5A:
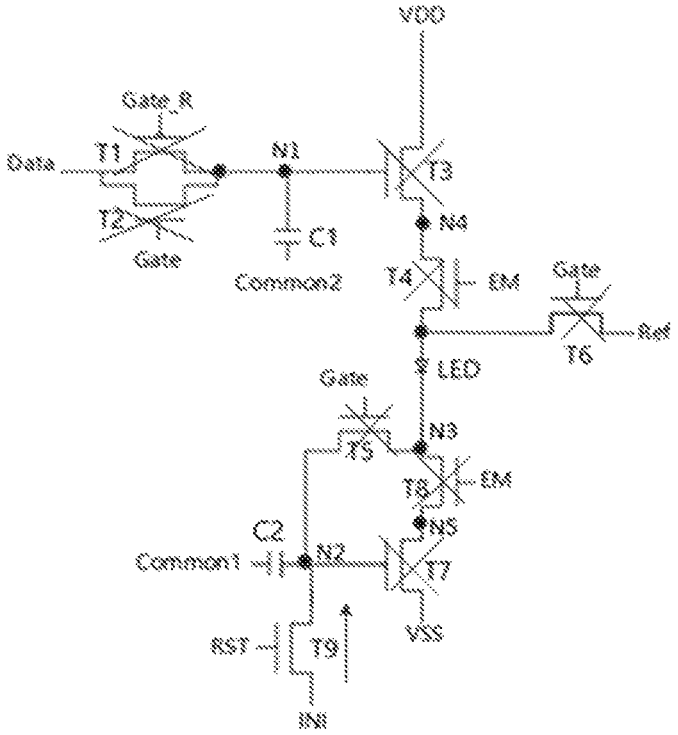
FIG. 5A is a schematic diagram showing an operation state of the pixel circuit in a reset phase according to an embodiment of the present disclosure.

In the reset phase, RST inputs high level, Gate inputs low level, Gate_R inputs high level, EM inputs low level; as shown in FIG. 5A, T9 is turned on, and other transistors are turned off, thereby providing the reset voltage Vini provided by INI to N2, where Vini is a lower potential, so that the LED is turned on at the beginning of the compensation phase.

Figure 5B:
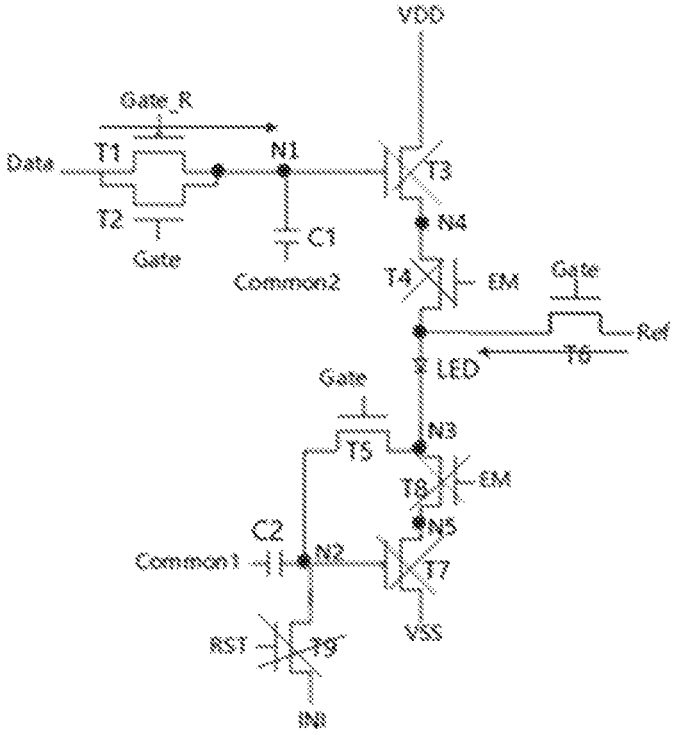
FIG. 5B is a schematic diagram showing an operation state of the pixel circuit in a compensation phase according to an embodiment of the present disclosure.

In the compensation phase, data reading and turn-on voltage compensation are performed; Gate inputs high level, Gate_R inputs low level, RST inputs low level, EM inputs low level; as shown in FIG. 5B, T1, T2, T5 and T6 are turned on, T3, T4, T8, T7 and T9 are turned off, Data writes the data voltage Vdata to N1, Ref writes the reference voltage Vref to the anode of LED, Vref charges C2 through T6, LED and T5 until the potential at N2 is Vref-Vf, then the LED is turned off and charging is stopped; where, Vf is the turn-on voltage of the LED; in the compensation phase, the voltage at Ni is maintained at Vdata.

Figure 5C:
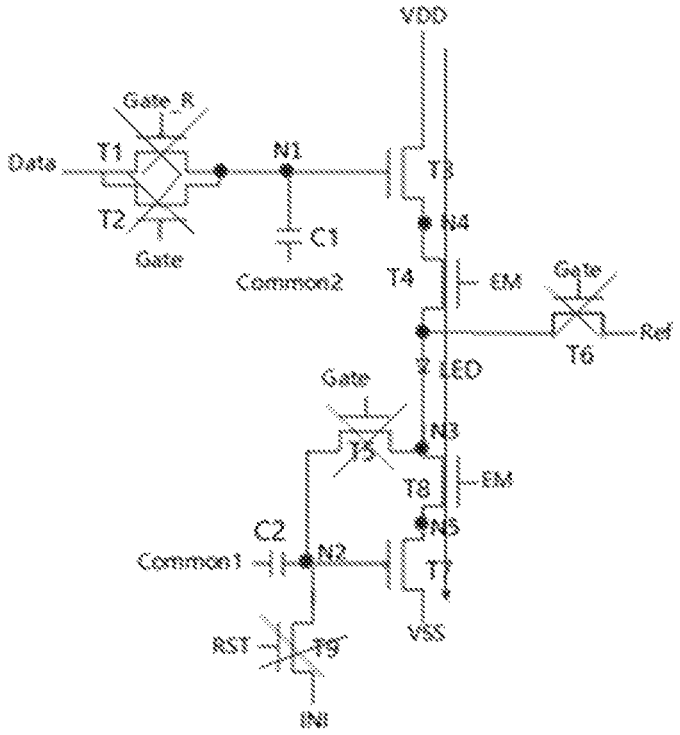
FIG. 5C is a schematic diagram showing an operation state of the pixel circuit in a light-emitting phase according to an embodiment of the present disclosure; the present disclosure.

In the light-emitting phase, EM inputs high level, Gate inputs low level, Gate_R inputs high level, RST inputs low level; as shown in FIG. 5C, T3, T4, T8 and T7 are turned on, T1, T2, T5, T6 and T8 are tuned off, T3 and T7 drive LED to emit light; the voltage at N1 is maintained at Vdata, the potential at N2 is maintained at Vref-Vf, the potential at N4 is changed to Vdata-Vth3, the potential at N5 is changed to Vref-Vf-Vth7, the potential at N3 is Vref-Vf-Vth7, where Vth3 is the threshold voltage of T3, and Vth7 is the threshold voltage of T7. In the light-emitting phase, T4 is fully turned on, the partial voltage at T4 is a fixed small voltage. Thus, a difference between an anode voltage of the LED and a cathode voltage of the LED is equal to Vdata-Vth3-(Vref-Vf-Vth7). The brightness of the LED is proportional to the current flowing through the LED, and the current is proportional to Vdata-Vth3-(Vref-Vf-Vth7)-Vf. Therefore, the current is independent of Vf. In other words, by employing the pixel circuit in the embodiment of the present disclosure, the brightness of the LED can be independent of Vf.

The pixel circuit according to one embodiment of the present disclosure can compensate for the influence of the turn-on voltage of the light-emitting diode on the light-emitting brightness, and then improve the uniformity of the light-emitting brightness.

In the related art, in the silicon-based display, because a size of a field effect transistor (FET) used in a source-follower structure is smaller, a higher pixels per inch (PPI) can be achieved, thereby achieving a virtual reality (VR)/augmented reality (AR) display with better display effect. A source-follower structure controls brightness by controlling voltages at two ends of a light-emitting diode. Light-emitting diodes have poor efficiency uniformity due to difference in material/process uniformity and attenuation uniformity in use, that is, the light-emitting diodes show different brightness when the same voltages are applied to two ends of each of the light-emitting diodes, which causes the brightness non-uniformity and chromaticity non-uniformity of the final display. In terms of light-emitting diode specifications, this non-uniformity is mainly manifested as difference in turn-on voltages Vf. Therefore, it is necessary to perform Vf compensation between pixels to improve display uniformity. Based on this, the pixel circuit according to one embodiment of the present disclosure performs Vf compensation on the cathode voltage of the light-emitting diode, which avoids the interference of Vf on the control data voltage and facilitates accurate control.

When the pixel circuit according to one embodiment of the present disclosure is in operation, the display period includes a compensation phase and a light-emitting phase that are sequentially set.

In the compensation phase, under control of the first write control signal, the first voltage control circuit writes the data voltage provided by the data line to the first node and maintains the voltage of the first node. Under control of the first gate drive signal provided by the first gate line, the reference voltage write circuit controls writing the reference voltage to the first electrode of the light-emitting element. Under control of the first gate drive signal, the second voltage control circuit controls the second electrode of the light-emitting element to be coupled with the control node, thereby controlling the light-emitting element to turn on, so that the control capacitor circuit is charged by the reference voltage, and the potential at the control node is changed accordingly, until the light-emitting element is turned off.

In the light-emitting phase, the second voltage control circuit controls the voltage at the follower node according to the voltage at the control node. The first voltage control circuit controls the voltage at the write node according to the voltage at the first node. Under control of the light-emitting control signal provided by the light-emitting control line, the light-emitting control circuit controls the write node to be coupled with the first electrode of the light-emitting element, and controls the second electrode of the light-emitting element to be coupled with the follower node, thereby controlling the light-emitting element to emit light.

Specifically, the second voltage control circuit may include a reset circuit, a switch circuit and a first voltage follower circuit. The display period further includes a reset phase before the compensation phase. In the reset phase, under control of the reset signal provided by the reset terminal, the reset circuit controls providing the reset voltage to the control node so that the light-emitting element is turned on at the beginning of the compensation phase.

Under control of the first gate drive signal, the second voltage control circuit controlling the second electrode of the light-emitting element to be coupled with the control node, includes: under control of the first gate drive signal, controlling, by the switch circuit, the control node to be coupled with the second electrode of the light-emitting element.

In the light-emitting phase, the second voltage control circuit controlling the voltage at the follower node according to the voltage at the control node, includes: controlling, by the first voltage follower circuit, the voltage at the follower node according to the voltage at the control node.

The present disclosure further provides a display device including the above pixel circuit.

Specifically, the display device in one embodiment of the present disclosure further includes a silicon substrate; and the pixel circuit is disposed on the silicon substrate.

The display device in one embodiment of the present disclosure may be any product or component with a display function, such as a virtual reality (VR) display device, an augmented reality (AR) display device, a mobile phone, a tablet computer, a television, a monitor, a notebook computer, a digital photo frame, and a navigator.

The above are merely the preferred embodiments of the present disclosure and shall not be used to limit the scope of the present disclosure. It should be noted that, a person skilled in the art may make improvements and modifications without departing from the principle of the present disclosure, and these improvements and modifications shall also fall within the scope of the present disclosure.

The invention claimed is:

1. A pixel circuit comprising:

a light-emitting element;

a first voltage control circuit;

a light-emitting control circuit;

a second voltage control circuit;

a control capacitor circuit; and a reference voltage write circuit;

wherein the first voltage control circuit is electrically coupled with a data line, a first node and a write node, respectively; the first voltage control circuit is configured to, under control of a first write control signal, write a data voltage provided by the data line to the first node and maintain a voltage at the first node, and control a voltage at the write node according to the voltage at the first node;

the reference voltage write circuit is electrically coupled with a first gate line and a first electrode of the light-emitting element, respectively; the reference voltage write circuit is configured to, under control of a first gate drive signal provided by the first gate line, control writing a reference voltage to the first electrode of the light-emitting element;

the control capacitor circuit is electrically coupled with a control node;

the second voltage control circuit is electrically coupled with a second electrode of the light-emitting element, the control node, a follower node and the first gate line, respectively; the second voltage control circuit is configured to, under control of the first gate drive signal, control the second electrode of the light-emitting element to be coupled with the control node, thereby controlling the light-emitting element to be turned on, so that the control capacitor circuit is charged by the reference voltage, a potential at the control node is changed accordingly, until the light-emitting element is turned off; the second voltage control circuit is further configured to control a voltage at the follower node according to a voltage at the control node;

the light-emitting control circuit is electrically coupled with a light-emitting control line, the write node, the first electrode of the light-emitting element, the second electrode of the light-emitting element, and the follower node, respectively; the light-emitting control circuit is configured to, under control of a light-emitting control signal provided by the light-emitting control line, control the write node to be coupled with the first electrode of the light-emitting element, and control the second electrode of the light-emitting element to be coupled with the follower node.

2. The pixel circuit according to claim 1, wherein the second voltage control circuit includes a reset circuit, a switch circuit, and a first voltage follower circuit;

the reset circuit is electrically coupled with a reset terminal and the control node, respectively; the reset circuit is configured to, under control of a reset signal provided by the reset terminal, control providing a reset voltage to the control node;

the switch circuit is electrically coupled with the first gate line, the control node and the second electrode of the light-emitting element, respectively; the switch circuit is configured to, under control of the first gate drive signal, control the control node to be coupled with the second electrode of the light-emitting element;

the first voltage follower circuit is electrically coupled with the control node and the follower node, respectively; the first voltage follower circuit is configured to control the voltage at the follower node according to the voltage at the control node.

3. The pixel circuit according to claim 2, wherein the reset circuit includes a reset transistor; the switch circuit includes a switch control transistor; the first voltage follower circuit includes a first source-follower transistor; the control capacitor circuit includes a control capacitor;

a control electrode of the reset transistor is electrically coupled with the reset terminal; a first electrode of the reset transistor is electrically coupled with a reset voltage terminal; a second electrode of the reset transistor is electrically coupled with the control node; the reset voltage terminal is configured to provide the reset voltage;

a control electrode of the switch control transistor is electrically coupled with the first gate line; a first electrode of the switch control transistor is electrically coupled with the second electrode of the light-emitting element; a second electrode of the switch control transistor is electrically coupled with the control node;

a gate electrode of the first source-follower transistor is electrically coupled with the control node; a source electrode of the first source-follower transistor is electrically coupled with the follower node; a second electrode of the first source-follower transistor is electrically coupled with a first voltage terminal;

a first terminal of the control capacitor is electrically coupled with the control node; a second terminal of the control capacitor receives a first common voltage.

4. The pixel circuit according to claim 1, wherein the reference voltage write circuit includes a reference voltage write transistor;

a control electrode of the reference voltage write transistor is electrically coupled with the first gate line; a first electrode of the reference voltage write transistor is electrically coupled with a reference voltage terminal; a second electrode of the reference voltage write transistor is electrically coupled with the first electrode of the light-emitting element; the reference voltage terminal is configured to provide the reference voltage.

5. The pixel circuit according to claim 1, wherein the first voltage control circuit includes a second voltage follower circuit, a data voltage write circuit, and a voltage maintenance circuit;

the second voltage follower circuit is configured to control the voltage at the write node according to the voltage at the first node;

the data voltage write circuit is configured to, under control of the first write control signal, write the data voltage to the first node;

the voltage maintenance circuit is configured to maintain the voltage at the first node.

6. The pixel circuit according to claim 5, wherein the second voltage follower circuit includes a second source-follower transistor, and the voltage maintenance circuit includes a storage capacitor;

a control electrode of the second source-follower transistor is electrically coupled with the first node; a drain electrode of the second source-follower transistor is electrically coupled with a power supply voltage terminal; a second electrode of the second source-follower transistor is electrically coupled with the write node;

a first terminal of the storage capacitor is electrically coupled with the first node; a second terminal of the storage capacitor receives a second common voltage.

7. The pixel circuit according to claim 5, wherein the first write control signal includes a first gate drive signal and a second gate drive signal;

the data voltage write circuit includes a first data write transistor and a second data write transistor;

a control electrode of the first data write transistor is electrically coupled with a second gate line; a first electrode of the first data write transistor is electrically coupled with the data line; a second electrode of the first data write transistor is electrically coupled with the first node;

a control electrode of the second data write transistor is electrically coupled with the first gate line; a first electrode of the second data write transistor is electrically coupled with the data line; a second electrode of the second data write transistor is electrically coupled with the first node;

the first data write transistor is a p-type transistor, and the second data write transistor is an n-type transistor.

8. The pixel circuit according to claim 1, wherein the light-emitting control circuit includes a first light-emitting control transistor and a second light-emitting control transistor;

a control electrode of the first light-emitting control transistor is electrically coupled with the light-emitting control line; a first electrode of the first light-emitting control transistor is electrically coupled with the write node; a second electrode of the first light- emitting control transistor is electrically coupled with the first electrode of the light- emitting element;

a control electrode of the second light-emitting control transistor is electrically coupled with a light-emitting control line; a first electrode of the second light-emitting control transistor is electrically coupled with the second electrode of the light-emitting element; a second electrode of the second light-emitting control transistor is electrically coupled with the follower node.

9. A display device, comprising: a pixel circuit;

wherein the pixel circuit includes: a light-emitting element, a first voltage control circuit, a light-emitting control circuit, a second voltage control circuit, a control capacitor circuit, and a reference voltage write circuit;

wherein the first voltage control circuit is electrically coupled with a data line, a first node and a write node, respectively; the first voltage control circuit is configured to, under control of a first write control signal, write a data voltage provided by the data line to the first node and maintain a voltage at the first node, and control a voltage at the write node according to the voltage at the first node;

the reference voltage write circuit is electrically coupled with a first gate line and a first electrode of the light-emitting element, respectively; the reference voltage write circuit is configured to, under control of a first gate drive signal provided by the first gate line, control writing a reference voltage to the first electrode of the light-emitting element;

the control capacitor circuit is electrically coupled with a control node;

the second voltage control circuit is electrically coupled with a second electrode of the light-emitting element, the control node, a follower node and the first gate line, respectively; the second voltage control circuit is configured to, under control of the first gate drive signal, control the second electrode of the light-emitting element to be coupled with the control node, thereby controlling the light-emitting element to be turned on, so that the control capacitor circuit is charged by the reference voltage, a potential at the control node is changed accordingly, until the light-emitting element is turned off; the second voltage control circuit is further configured to control a voltage at the follower node according to a voltage at the control node;

the light-emitting control circuit is electrically coupled with a light-emitting control line, the write node, the first electrode of the light-emitting element, the second electrode of the light-emitting element, and the follower node, respectively; the light-emitting control circuit is configured to, under control of a light-emitting control signal provided by the light-emitting control line, control the write node to be coupled with the first electrode of the light-emitting element, and control the second electrode of the light-emitting element to be coupled with the follower node.

10. The display device according to claim 9, wherein the display device further includes a silicon substrate; and the pixel circuit is disposed on the silicon substrate.

11. The display device according to claim 10, wherein the second voltage control circuit includes a reset circuit, a switch circuit, and a first voltage follower circuit;

the reset circuit is electrically coupled with a reset terminal and the control node, respectively; the reset circuit is configured to, under control of a reset signal provided by the reset terminal, control providing a reset voltage to the control node;

the switch circuit is electrically coupled with the first gate line, the control node and the second electrode of the light-emitting element, respectively; the switch circuit is configured to, under control of the first gate drive signal, control the control node to be coupled with the second electrode of the light-emitting element;

the first voltage follower circuit is electrically coupled with the control node and the follower node, respectively; the first voltage follower circuit is configured to control the voltage at the follower node according to the voltage at the control node.

12. The display device according to claim 11, wherein the reset circuit includes a reset transistor; the switch circuit includes a switch control transistor; the first voltage follower circuit includes a first source-follower transistor; the control capacitor circuit includes a control capacitor;

a control electrode of the reset transistor is electrically coupled with the reset terminal; a first electrode of the reset transistor is electrically coupled with a reset voltage terminal; a second electrode of the reset transistor is electrically coupled with the control node; the reset voltage terminal is configured to provide the reset voltage;

a control electrode of the switch control transistor is electrically coupled with the first gate line; a first electrode of the switch control transistor is electrically coupled with the second electrode of the light-emitting element; a second electrode of the switch control transistor is electrically coupled with the control node;

a gate electrode of the first source-follower transistor is electrically coupled with the control node; a source electrode of the first source-follower transistor is electrically coupled with the follower node; a second electrode of the first source-follower transistor is electrically coupled with a first voltage terminal;

a first terminal of the control capacitor is electrically coupled with the control node; a second terminal of the control capacitor receives a first common voltage.

13. The display device according to claim 12, wherein the reference voltage write circuit includes a reference voltage write transistor;

a control electrode of the reference voltage write transistor is electrically coupled with the first gate line; a first electrode of the reference voltage write transistor is electrically coupled with a reference voltage terminal; a second electrode of the reference voltage write transistor is electrically coupled with the first electrode of the light-emitting element; the reference voltage terminal is configured to provide the reference voltage.

14. The display device according to claim 13, wherein the first voltage control circuit includes a second voltage follower circuit, a data voltage write circuit, and a voltage maintenance circuit;

the second voltage follower circuit is configured to control the voltage at the write node according to the voltage at the first node;

the data voltage write circuit is configured to, under control of the first write control signal, write the data voltage to the first node;

the voltage maintenance circuit is configured to maintain the voltage at the first node.

15. The display device according to claim 14, wherein the second voltage follower circuit includes a second source-follower transistor, and the voltage maintenance circuit includes a storage capacitor;

a control electrode of the second source-follower transistor is electrically coupled with the first node; a drain electrode of the second source-follower transistor is electrically coupled with a power supply voltage terminal; a second electrode of the second source-follower transistor is electrically coupled with the write node;

a first terminal of the storage capacitor is electrically coupled with the first node; a second terminal of the storage capacitor receives a second common voltage.

16. The display device according to claim 15, wherein the first write control signal includes a first gate drive signal and a second gate drive signal;

the data voltage write circuit includes a first data write transistor and a second data write transistor;

a control electrode of the first data write transistor is electrically coupled with a second gate line; a first electrode of the first data write transistor is electrically coupled with the data line; a second electrode of the first data write transistor is electrically coupled with the first node;

a control electrode of the second data write transistor is electrically coupled with the first gate line; a first electrode of the second data write transistor is electrically coupled with the data line; a second electrode of the second data write transistor is electrically coupled with the first node;

the first data write transistor is a p-type transistor, and the second data write transistor is an n-type transistor.

17. The display device according to claim 16, wherein the light-emitting control circuit includes a first light-emitting control transistor and a second light-emitting control transistor;

a control electrode of the first light-emitting control transistor is electrically coupled with the light-emitting control line; a first electrode of the first light-emitting control transistor is electrically coupled with the write node; a second electrode of the first light- emitting control transistor is electrically coupled with the first electrode of the light- emitting element;

a control electrode of the second light-emitting control transistor is electrically coupled with a light-emitting control line; a first electrode of the second light-emitting control transistor is electrically coupled with the second electrode of the light-emitting element; a second electrode of the second light-emitting control transistor is electrically coupled with the follower node.

* * * * *